US007948442B2

(12) United States Patent
Hatazawa

(10) Patent No.: US 7,948,442 B2
(45) Date of Patent: May 24, 2011

(54) RADIO WAVE RECEIVING CONVERTER AND SATELLITE BROADCAST RECEIVING ANTENNA DEVICE

(75) Inventor: Kenji Hatazawa, Tondabayashi (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 377 days.

(21) Appl. No.: 12/179,307

(22) Filed: Jul. 24, 2008

(65) Prior Publication Data

US 2009/0027290 A1 Jan. 29, 2009

(30) Foreign Application Priority Data

Jul. 25, 2007 (JP) ..... 2007-193686

(51) Int. Cl.
*H01Q 13/00* (2006.01)
*H01Q 19/00* (2006.01)

(52) U.S. Cl. ..... 343/786; 343/756

(58) Field of Classification Search ..... 343/756, 343/772, 786
See application file for complete search history.

(56) References Cited

U.S. PATENT DOCUMENTS 5,455,085 A * 10/1995 Miller ..... 428/34
6,118,412 A * 9/2000 Chen ..... 343/756
6,140,893 A * 10/2000 Sciarrino ..... 333/254
6,819,299 B2 11/2004 Miyazaki

FOREIGN PATENT DOCUMENTS

JP 63-169702 U 11/1988
JP 8-316701 A 11/1996
JP 2003-243901 A 8/2003
JP 2004-120348 A 4/2004

* cited by examiner

*Primary Examiner* — Shih-Chao Chen
(74) *Attorney, Agent, or Firm* — Birch, Stewart, Kolasch & Birch, LLP

(57) ABSTRACT

A radio wave receiving converter includes a main body portion including a first waveguide having a male thread on an outer circumference of the first waveguide, a feedhorn including a second waveguide having a female thread on an inner circumference of the second waveguide, a ring-shaped member including a circumferential wall portion and an annular step portion such that a groove portion where a portion near a tip of the second waveguide is inserted between the ring-shaped member and the outer circumference of the first waveguide is formed, and a sealing agent injected into a groove portion "b". By this configuration, there is provided a radio wave receiving converter that has a simple structure of a connecting portion, has improved productivity of the components and assemblability of the finished components, and can achieve a reduction in size and weight.

17 Claims, 13 Drawing Sheets

RADIO WAVE RECEIVING CONVERTER AND SATELLITE BROADCAST RECEIVING ANTENNA DEVICE

This nonprovisional application is based on Japanese Patent Application No. 2007-193686 filed on Jul. 25, 2007 with the Japan Patent Office, the entire contents of which are hereby incorporated by reference.

BACKGROUND OF THE INVENTION

1. Field of the Invention

The present invention relates to a satellite broadcast receiving converter, and more particularly, to a fixation and airtight structure for a Low Noise Block Down Converter (that will be referred to as "LNB" hereinafter) that employs a structure where a waveguide connected to a main body portion of the LNB and a waveguide portion of a primary radiator (feedhorn) connected to a tip of the waveguide are separated.

2. Description of the Background Art

Conventional arts will be described with reference to the drawings. FIG. 15 is a schematic diagram of an LNB combined with an antenna system. A radio wave reflected from a parabolic antenna 1 is input to a primary radiator 2 of the LNB.

FIGS. 16 and 17 are cross-sectional views of a general LNB. As shown in these figures, a main body portion (that will be described hereinafter) as well as a waveguide portion 3 and a primary radiator (feedhorn) 2 are integrated in the LNB in most cases and this structure is considered to be ideal in terms of performance. In the main body portion, a circuit board 6 is fixed to a chassis 4 and a frame 5 by a screw 7. A radio wave input from primary radiator 2 is fed to circuit board 6 via waveguide 3 and is output from an F connector 8 after frequency conversion. A cap 9 is fixed to a tip of primary radiator 2 and air tightness is maintained by an O-ring 10.

A recent trend is an increasing number of multi-satellite receiving LNBs as shown in FIG. 18. For example, for a three-satellite receiving converter, a converter has been conventionally configured by arranging three independent LNBs side by side or the like. Recently, however, there is a tendency that LNBs are integrated into a single unit. One of the problems here is a fabrication of an enclosure portion containing a main body portion, a waveguide and a primary radiator. In particular, an enclosure is often made by aluminum die casting, and it is very difficult to stably cast a large and complex-shaped enclosure. Especially in the LNB, it is difficult to keep a casting balance between the waveguide, the primary radiator and the main body portion, and problems such as a reduction in yield, a decrease in dimensional accuracy or a misrun arise. In addition, it is highly likely that the cost of the enclosure portion is increased as a result of a reduction in die life due to an impossible casting condition as well as an increase in weight and degradation in an appearance due to design constraints related to a die structure, and the like. Regarding the material cost, because of the soaring market price, it is also essential in terms of cost and for environmental reasons to reduce the size and weight of the enclosure portion.

As a solution to the above-described problems, it is common to separate the primary radiator portion including the waveguide as a different part, in particular. As a result of the separation, a die structure used for molding the respective parts is simplified and casting is readily performed. Consequently, the productivity is improved and the cost can be reduced. It should be noted that, as a result of the separation, electrical and mechanical performance, air tightness and assemblability should be mainly considered.

The conventional arts of a connecting portion between a waveguide 3 and a feedhorn 2 will be described hereinafter based on FIGS. 19-21. A male thread 11 is formed on an outer circumference of a connecting surface on the chassis side by dicing, and a female thread 12 is formed on the primary radiator side by tapping. Enough electrical contact between a connecting surface on the waveguide 3 side and a connecting surface on the primary radiator 2 side is ensured by screwing-in and tightening, and enough mechanical holding is achieved against a displacement, unscrewing or the like due to mechanical pulling, severe changes in the temperature outside, vibrations on an antenna, or the like. The airtight performance of a joint portion is maintained by applying an adhesive (a sealing agent) 13 to a screwed portion at the time of assembly and further having a fixed O-ring 10 between a tip of primary radiator 2 and an inner surface of a cap 9.

Prior documents disclosing the conventional arts regarding this type of fixation of a waveguide and a feedhorn include Japanese Patent Laying-Open No. 2003-243901, Japanese Patent Laying-Open No. 2004-120348, Japanese Patent Laying-Open No. 08-316701, and the like. Japanese Patent Laying-Open No. 2003-243901 discloses a method of maintaining air tightness by combining a sheet member, a rubber mold and an O-ring as well as by forming a groove portion in a main body portion to hold a sealing agent.

Disclosed in Japanese Patent Laying-Open No. 2004-120348 is a structure that employs a sheet member and a seal or an adhesive as means for maintaining air tightness similarly to that described in the above Japanese Patent Laying-Open No. 2003-243901. Although a method of fixation is not particularly described, a technique for complete mechanical fixation includes a screw-in system as described above or fixation by a screw.

On the other hand, Japanese Patent Laying-Open No. 08-316701 describes the most common structure for maintaining air tightness where the air tightness is maintained by interposing an O-ring in a flange portion fixed by a screw.

In the foregoing conventional examples shown in FIGS. 19-21, although the adhesive is applied to a screw portion (application of a seal) to maintain air tightness, a work often moves (longitudinally, transversely or reversely) at the time of assembly. Furthermore, variations in penetration of the adhesive into the screw portion cause variations in air tightness, and inspections, adjustments or the like are required in some cases. In addition, in the foregoing conventional examples, the adhesive is likely to be squeezed out and a bond needs to be wiped. Hold-and-wait is also required at the time of curing in order to prevent the bond from dripping. Therefore, the productivity is decreased.

Moreover, as for a product requiring the application of coating from the viewpoint of specifications thereof, an influence of the adhesive on the coating needs to be considered. A cleaning process needs to be added and the adhesive needs to be selected in consideration of chemical resistance, heat resistance or the like. In the foregoing conventional examples, a work is coated in a single unit state and assembled, and a flaw or peeling occurs in the coated portion when the coated work is assembled. In addition, the adhesive is squeezed out and wiped, and there are also constraints at the time of curing. Again, the conventional examples are less productive.

As the foregoing conventional examples described in Japanese Patent Laying-Open No. 2003-243901, in the method of maintaining air tightness by combining the sheet member with the rubber mold and the O-ring, a twist due to rotation occurs at the sheet member and the adhesive at the time of screwing-in and fixation. As a result, an adhesive layer is partially destructed or the sheet is deflected. Therefore, air tightness and performance are adversely affected. In addition, it should also be considered that the waveguide portion ideally includes nothing from the viewpoint of performance.

In a case where an O-ring is used, accuracy of a contact surface and an exact crushing rate need to be managed in order to prevent a tear of the O-ring or the poor air tightness of a rough surface portion. As a result, the cost needs to be increased to ensure accuracy of the components. In addition, unless a lubricant such as grease is necessarily used together when the O-ring is compressed by being screwed in, the O-ring is likely to be broken. In particular, as the cross-sectional diameter of the O-ring becomes small, the risk of breakage is significantly increased.

Japanese Patent Laying-Open No. 2003-243901 describes a structure for holding the sealing agent within the groove portion that is formed in a connecting portion between the waveguide on the main body portion side of an LNB and the waveguide portion including the primary radiator (feedhorn). In a structure shown in FIGS. 4 and 6 in the document, the feedhorn side extends so as to cover the waveguide portion of the main body, and air tightness is maintained at a base portion of the main body. The reason why the air tightness is maintained at the base portion may be that, because a groove portion and an outer wall portion need to be formed, the waveguide portion becomes thick, and thus the feedhorn side is extended and fixed.

However, the feedhorn side is extended, so that the component becomes large and a sliding portion of a die becomes long. This is undeniably disadvantageous in terms of castability and the material cost. If the thickness of an extension is reduced, a misrun, the poor air tightness due to a blowhole or a fitting trouble due to deformation is likely to occur. As a result, there is concern that yield of components is worsened. From the viewpoint of the specifications, the longer the waveguide portion is, the more disadvantageous the structure is, In contrast, in a structure shown in FIG. 10 in Japanese Patent Laying-Open No. 2003-243901, the groove portion and the outer wall are provided at the tip. In this case, due to a die structure made in consideration of a process where a molded product is drawn from the die, the waveguide thickness of the groove portion and the outer wall portion must be increased to the base of the main body portion because it is desired that the thickness is at least 0.8 mm or more in consideration of a misrun and the strength of the die from the viewpoint of die cast molding.

Considering the foregoing, it is expected that the thickness is increased by approximately as much as 2 mm including at least the width of the outer wall (0.8 mm) and the width of the groove (0.8 mm for the thickness of a feed insertion portion and 0.2 mm×2 for right and left clearances). In addition to an increase in the material cost, galling is likely to occur because of the uneven thickness (thickness), in particular in the die casting. Furthermore, considering that deformation of the tip due to a deburring process that is one process during the whole process is prevented and a specially-shaped cutting tool is used at the time of threading machining, it is essentially ideal that the structure has a larger dimension.

Japanese Patent Laying-Open No. 2004-120348 describes the structure that employs the sheet member and the seal or the adhesive as means for maintaining air tightness similarly to the above. Although a method of fixation is not particularly described, the screw-in system as described above or fixation by a screw is regarded as a technique for complete mechanical fixation. Similarly, a twist due to rotation occurs at the sheet member and the adhesive in a case of screwing-in. As a result, an adhesive layer is partially destructed or the sheet is deflected. Therefore, there is concern that air tightness and performance are adversely affected. In addition, the waveguide portion ideally includes nothing from the viewpoint of performance.

On the other hand, as described in Japanese Patent Laying-Open No. 08-316701, there is also a method of fixing a flange portion by a screw. In a fixation structure for a waveguide including an LNB, however, it is a problem that the structure becomes large and a die structure becomes complicated. Furthermore, when the flange portion is fixed by the screw, the flange portion needs to be tightened diagonally. Therefore, the structure does not have good workability.

SUMMARY OF THE INVENTION

In order to solve the above-described problems, an object of the present invention is to provide a radio wave receiving converter that has a simple structure of a connecting portion between a waveguide on a main body side and a waveguide on a feedhorn side, has improved productivity of the components and assemblability of the finished components, and can achieve a reduction in size and weight, and a satellite broadcast receiving antenna device including the radio wave receiving converter.

In order to achieve the above-described object, a radio wave receiving converter according to the present invention relates to a fixation and airtight structure for a waveguide connected to a main body portion of an LNB and a waveguide including a primary radiator (feedhorn) connected to a tip of the former waveguide, and includes a ring-shaped member arranged on an outer circumference of a connecting portion between the waveguide and the waveguide including the primary radiator (feedhorn) connected to the tip of the former waveguide.

More specifically, a radio wave receiving converter for receiving a satellite broadcast includes a main body portion including a first waveguide having a male thread on an outer circumference of the first waveguide, and a feedhorn including a second waveguide having a female thread on an inner circumference of the second waveguide that is screwed on the male thread. A ring-shaped member is arranged so as to cover a connecting portion having a circumferential gap between the first waveguide and the second waveguide. The ring-shaped member includes a circumferential wall portion and an annular step portion such that a groove portion where a portion near a tip of the second waveguide is inserted between the ring-shaped member and the outer circumference of the first waveguide is formed. The radio wave receiving converter further includes a sealing agent injected into the groove portion.

According to this configuration, the sealing agent is injected before or after assembly, so that an airtight portion having smaller variations can be ensured with ease and with good workability. Moreover, assembly, application of an adhesive, and leaving in a dry form can be readily carried out. Therefore, the productivity is improved. In addition, the ring-shaped member can be made of, in particular, a thin member such as a plate or a resin. The use of deformability that a thin plate, resin or the like has allows the ring-shaped member to be designed with little clearance. Furthermore, problems of an increase in the material cost and the productivity due to the thickness can be solved, and the size and weight of the configuration can be further reduced.

This configuration is not a configuration that employs a sheet member and a seal or an adhesive as means for maintaining air tightness, and does not have any inclusion within the waveguides. Therefore, the configuration shows excellent performance. Furthermore, a fixing portion like a flange portion does not have to be formed. Therefore, a die can be simplified and a small LNB having excellent productivity and appearance can be provided.

In another aspect, a radio wave receiving converter according to the present invention relates to a fixation and airtight structure for a first waveguide connected to a main body portion of an LNB and a primary radiator (feedhorn) including a second waveguide connected to a tip of the first waveguide, and has a structure where a screw fixing hole is provided for fixation in a corrugated groove portion of the primary radiator. More specifically, a radio wave receiving converter includes a main body portion including a first waveguide, and a feedhorn including a second waveguide connected to the first waveguide. A screw fixing hole is provided in a bottom of a circumferential groove portion of the feedhorn. A screw hole is provided in a tip of the first waveguide. A screw is screwed and fixed in the screw hole of the first waveguide through the screw fixing hole of the feedhorn.

By this configuration, a reduction of process steps is expected because a male thread and a female thread does not have to be processed. A collar portion like a flange for fixation as described in Japanese Patent Laying-Open No. 08-316701 does not have to be given. Therefore, a small LNB having excellent productivity and appearance can be provided.

In addition, means for solving the problems of the present invention includes various embodiments that will follow. For example, in a fixation and airtight structure for a waveguide including a primary radiator (feedhorn) having a second waveguide connected to a tip of a first waveguide, a connecting portion between the first waveguide and the second waveguide is covered with a cabinet. By this configuration, coating of the primary radiator is eliminated and a bond squeezed out of the inside, a flaw or the like does not appear, so that the productivity is improved. In particular, in the coating of a feedhorn portion having a complicated shape, masking and/or uniform coating often leads to high costs. Therefore, this structure is advantageous in terms of productivity of the components and assemblability of the finished components.

The present invention is also applicable to a fixation and airtight structure for a first waveguide connected to a main body portion of an LNB where at least more than one primary radiator (feedhorn) need to be arranged, and a primary radiator (feedhorn) having a second waveguide connected to a tip of the first waveguide.

When a ring-shaped member is formed of a metal or a conductive resin, an effect that leakage of a radio wave in a joint portion is suppressed can be obtained. Furthermore, when a sealing agent is conductive, a similar effect can be obtained. Moreover, the present invention also includes an antenna device including the above-described converter.

According to the present invention, in a fixation and airtight structure for a connecting portion between a first waveguide on a main body portion side of an LNB where a primary radiator (feedhorn) needs to be arranged, and a second waveguide included in a primary radiator (feedhorn), there can be provided an LNB having improved productivity of the components and assemblability of the finished components, and in addition, being compact and lightweight and having an excellent appearance even if the LNB has a plurality of complex-shaped primary radiators.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
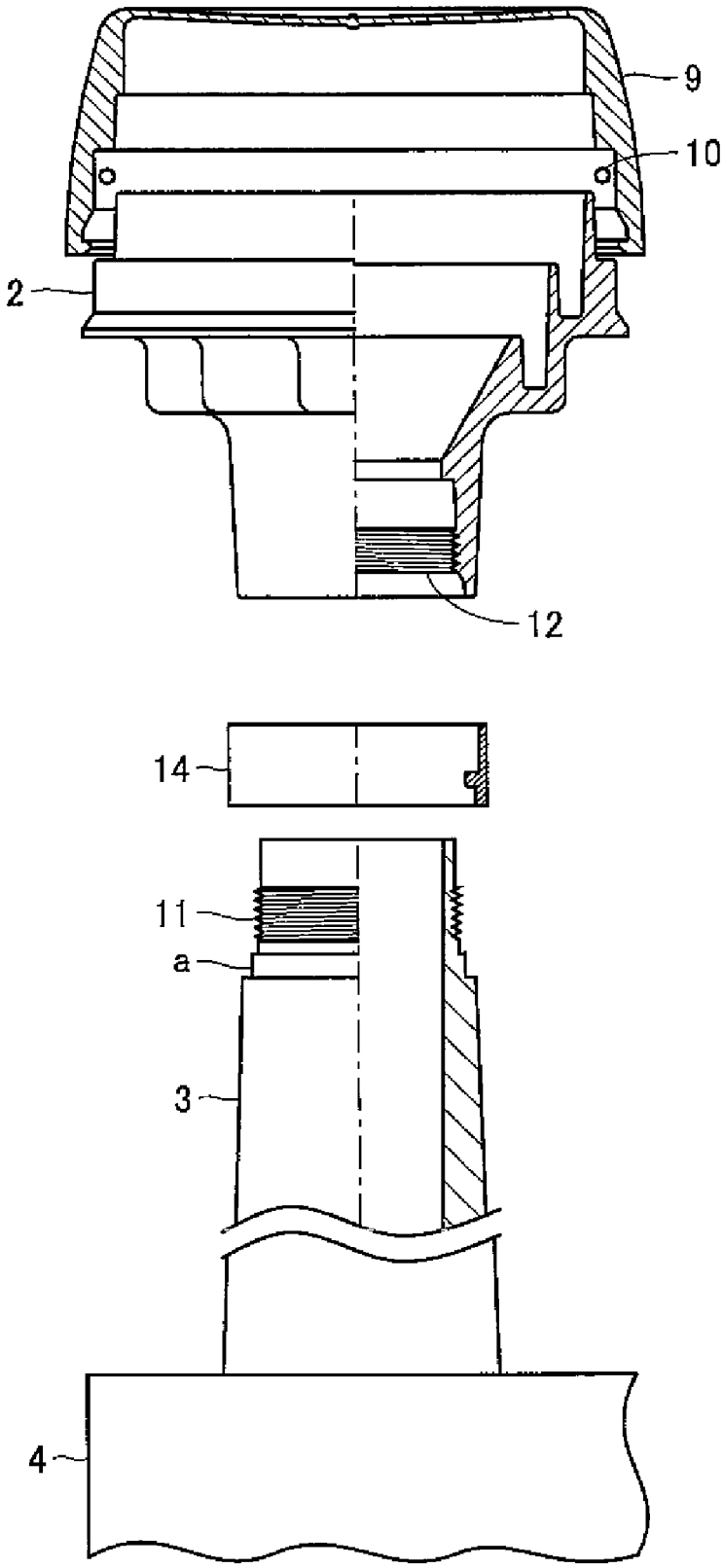
FIG. 1 is a partially exploded cross-sectional view of one embodiment of the present invention.
Figure 2:
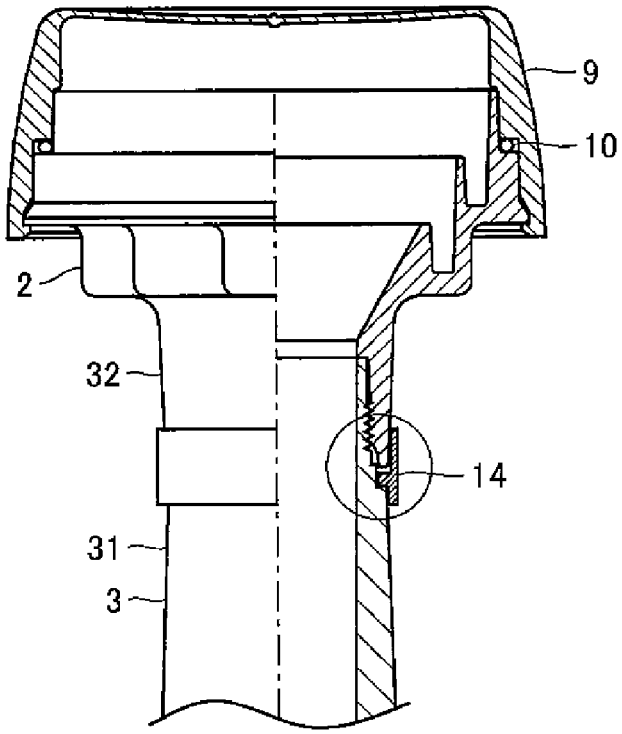
FIG. 2 is a partial cross-sectional view of the embodiment in FIG. 1.
Figure 3:
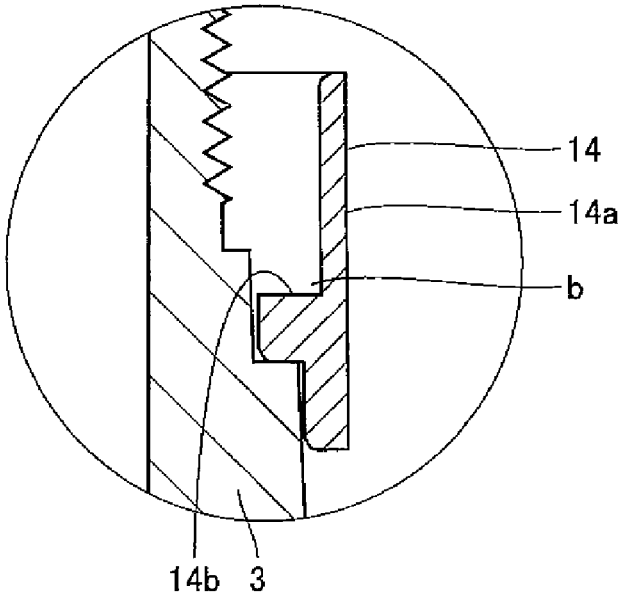
FIG. 3 is an enlarged view of a ring-shaped member 14 attached to a waveguide portion 3.
Figure 4:
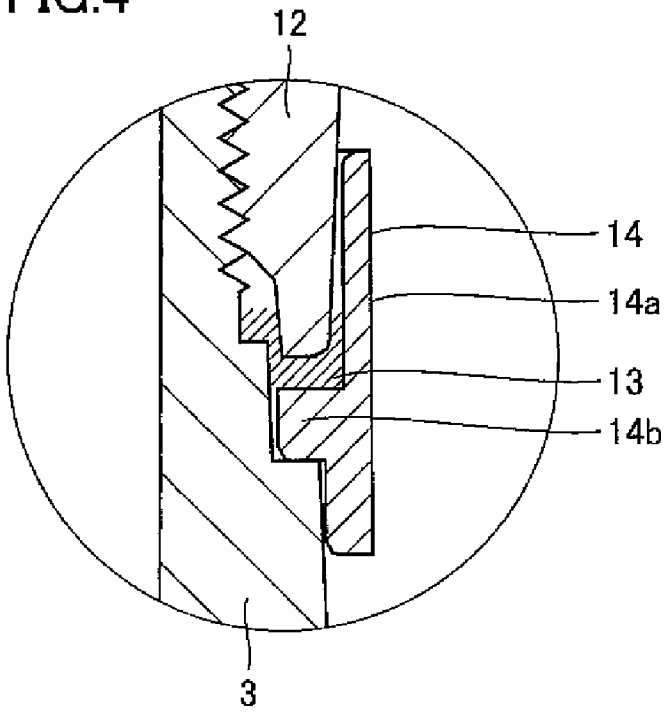
FIG. 4 is an enlarged view of a main part in the proximity of ring-shaped member 14 in FIG. 2.

The embodiments of the present invention will be described hereinafter based on the drawings. FIGS. 1-4 show a radio wave receiving converter according to one embodiment of the present invention and relate to a fixation and airtight structure for a waveguide connected to a main body portion of an LNB and a waveguide including a primary radiator (feedhorn) connected to a tip of the former waveguide.

As shown in FIGS. 1-4, a first waveguide 31 having a male thread 11 on an outer circumference thereof protrudes from a chassis 4 of the main body portion. A second waveguide 32 having a female thread 12 on an inner circumference thereof that is screwed on male thread 11 is formed integrally with a feedhorn 2. Feedhorn 2 is a corrugated horn and has a plurality of concentric circumferential grooves. A ring-shaped member 14 is arranged so as to cover a connecting portion having a circumferential gap between first and second waveguides 31 and 32. This ring-shaped member 14 has a circumferential wall portion 14*a* and an annular step portion 14*b* such that a groove portion where a portion near a tip of the second waveguide is inserted between ring-shaped member 14 and the outer circumference of the first waveguide is formed. A sealing agent 13 is injected into the groove portion.

In this manner, male thread 11 is formed on the outer circumference of a tip of first waveguide 31 on the chassis side by dicing, and female thread 12 is formed on the primary radiator side by tapping. The tip has a step to reduce the diameter in order that male thread 11 may not be formed on the step portion at the time of dicing. This eliminates failure in screwing in incomplete female thread portions (about three threads) on the innermost end of the tap-hole that are formed on the primary radiator side at the time of general tapping.

Ring-shaped member 14 is fit and put on a step "a", so that a position thereof is determined. In consideration of costs and a small (thin) shape, it is desirable to fabricate ring-shaped member 14 in a pressed component or a molded component. Ring-shaped member 14 in the figures is formed in a molded component. It should be noted that leakage of a radio wave from a joint portion can be reduced if ring-shaped member 14 is formed in a molded component and is made from a conductive material such as metal powder or carbon.

Thereafter, sealing agent 13 is injected into a groove portion "b" formed by putting ring-shaped member 14 on, and primary radiator 2 is screwed in and tightened. As a result, enough electrical contact of a connecting surface between waveguide 31 and waveguide 32 on the primary radiator 2 side can be ensured, and enough mechanical holding is achieved against a displacement, unscrewing (pulling) or the like due to mechanical pulling, changes in the temperature, vibrations, or the like. The sealing agent may be injected after primary radiator 2 is screwed in. For example, a low-viscosity adhesive is injected by a dispenser. The use of a conductive sealing agent allows a further reduction in leakage of a radio wave.

Figure 5:
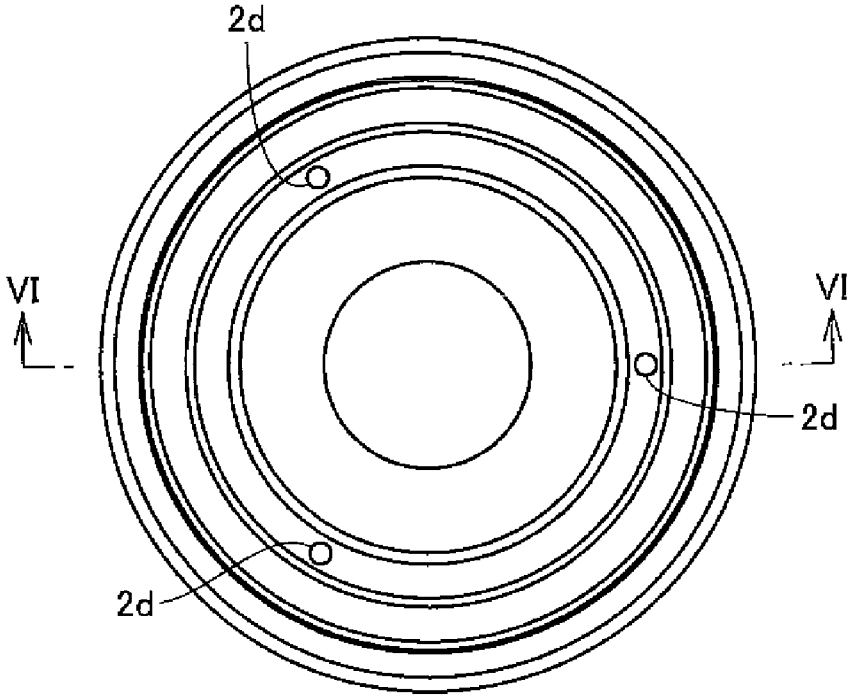
FIG. 5 is a plan view of a structure where concave-convex holes are provided in a groove portion of a feedhorn according to an embodiment of the present invention.
Figure 6:
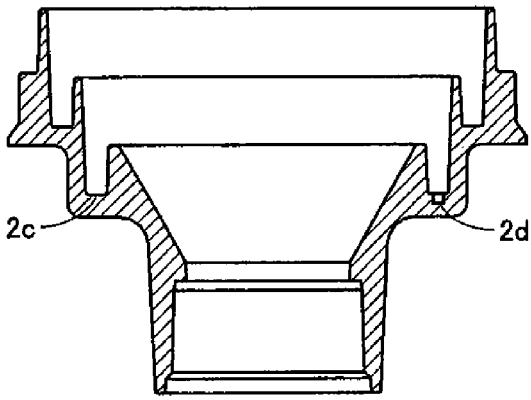
FIG. 6 is a cross-sectional view taken along line VI-VI in FIG. 5.
Figure 7:
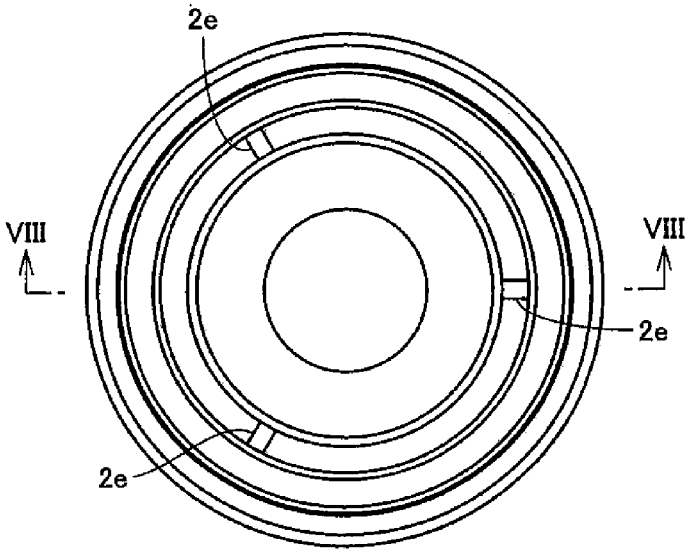
FIG. 7 is a plan view of a structure where ribs are provided at a groove portion of a feedhorn according to the embodiment of the present invention.
Figure 8:
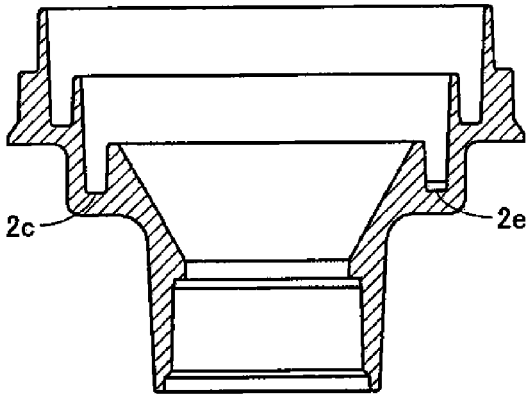
FIG. 8 is a cross-sectional view taken along line VIII-VIII in FIG. 7.

FIGS. 5 and 6 show a structure where concave-shaped holes 2*d* are provided in a corrugated groove portion 2*c* of the primary radiator. FIGS. 7 and 8 show a structure where convex-shaped ribs 2*e* are provided. By these structures, when the female thread of feedhorn 2 is tightened on the male thread, attachment of a fitting jig or the like to a tip of an electric screwdriver allows the female thread to be tightened and fixed readily and rapidly.

Figure 9:
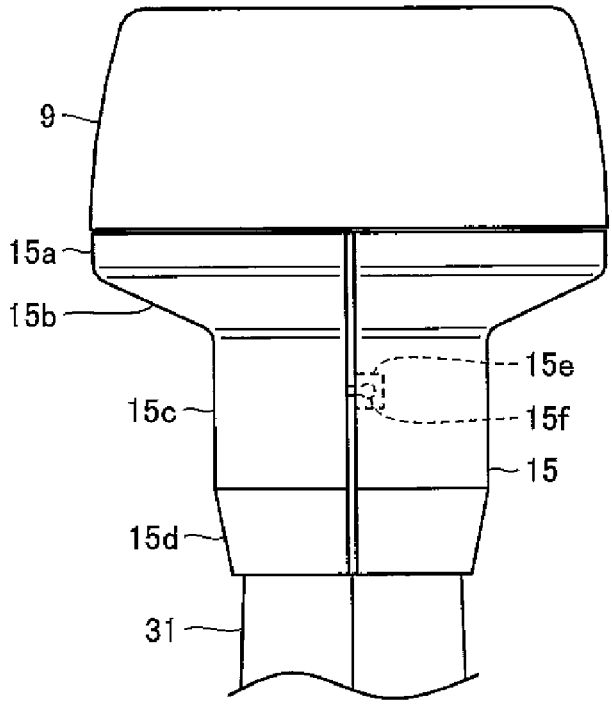
FIG. 9 is a front view of a state where a cabinet according to the embodiment of the present invention is attached.
Figure 10:
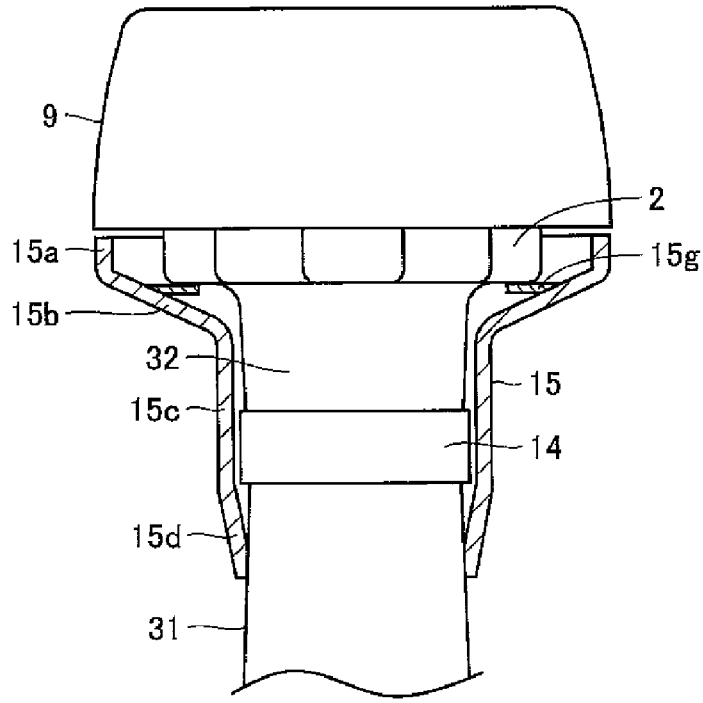
FIG. 10 is a cross-sectional view of cabinet 15 in FIG. 9.

Furthermore, the embodiment shown in FIGS. 9 and 10 has a structure where the connecting portion between waveguides 31 and 32 is covered with a cabinet 15. By this structure, coating of the primary radiator can be eliminated and a bond squeezed out of the inside, a flaw or the like does not have to be considered, so that the productivity is improved. In particular, in the coating of a feedhorn portion having a complicated shape, masking and/or uniform coating often leads to high costs. Therefore, this structure is advantageous in terms of productivity of the components and assemblability of the finished components.

Cabinet 15 includes a first cylindrical portion 15*a* having the outside diameter substantially equal to the outside diameter of feedhorn 2, a second cylindrical portion 15*c* covering a smaller-diameter portion of the feedhorn and the waveguide connecting portion, and a first tapered cylindrical portion 15*b* connecting both of these cylindrical portions. Cabinet 15 is divided into two portions along a plane including a central axis, and the two portions are bonded to each other at a portion where the two portions face each other, for example, by snap joint or the like by a pair of male and female engaging members 15*e* and 15*f* as shown by a broken line in FIG. 9.

An abutting strip 15*g* is provided inside first tapered cylindrical portion 15*b* such that, when the feedhorn is connected to the waveguide, the outer circumferential portion of feedhorn 2 abuts on abutting strip 15*g* and a pressing force is generated on the first waveguide 31 side due to elastic deformation. Therefore, when cabinet 15 is attached, an end thereof (shown below) is positioned at a tapered outer surface that becomes thick toward the lower side of the first waveguide.

Figure 11:
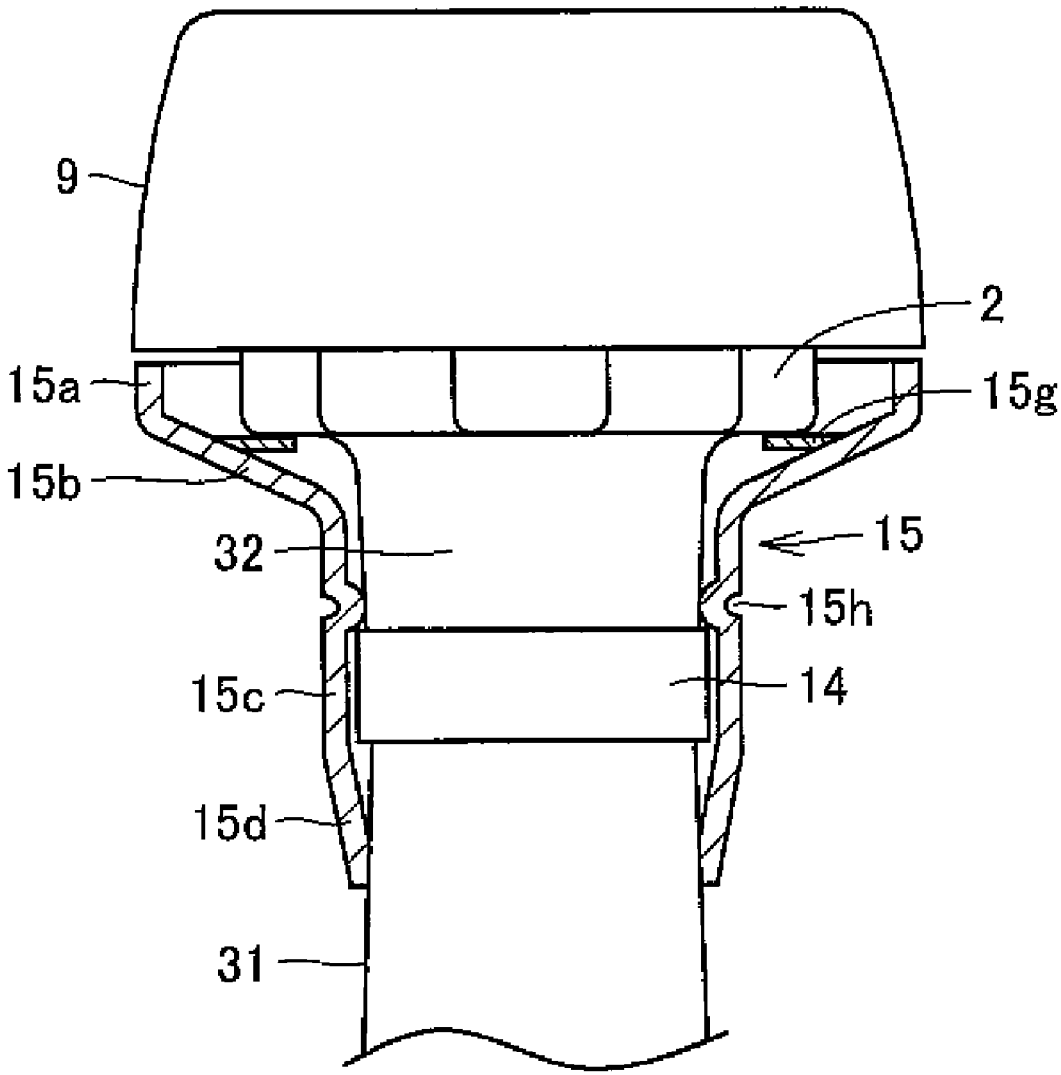
FIG. 11 is a front view of another embodiment of a state where the cabinet of the present invention is attached.

In FIG. 11, the cabinet is positioned by ring-shaped member 14. Provided on the inner surface of second cylindrical portion 15*c* of the cabinet is a circumferential ridge 15*h* projecting in such a manner that second cylindrical portion 15*c* has a diameter smaller than the outside diameter of ring-shaped member 14 of the connecting portion.

Figure 12:
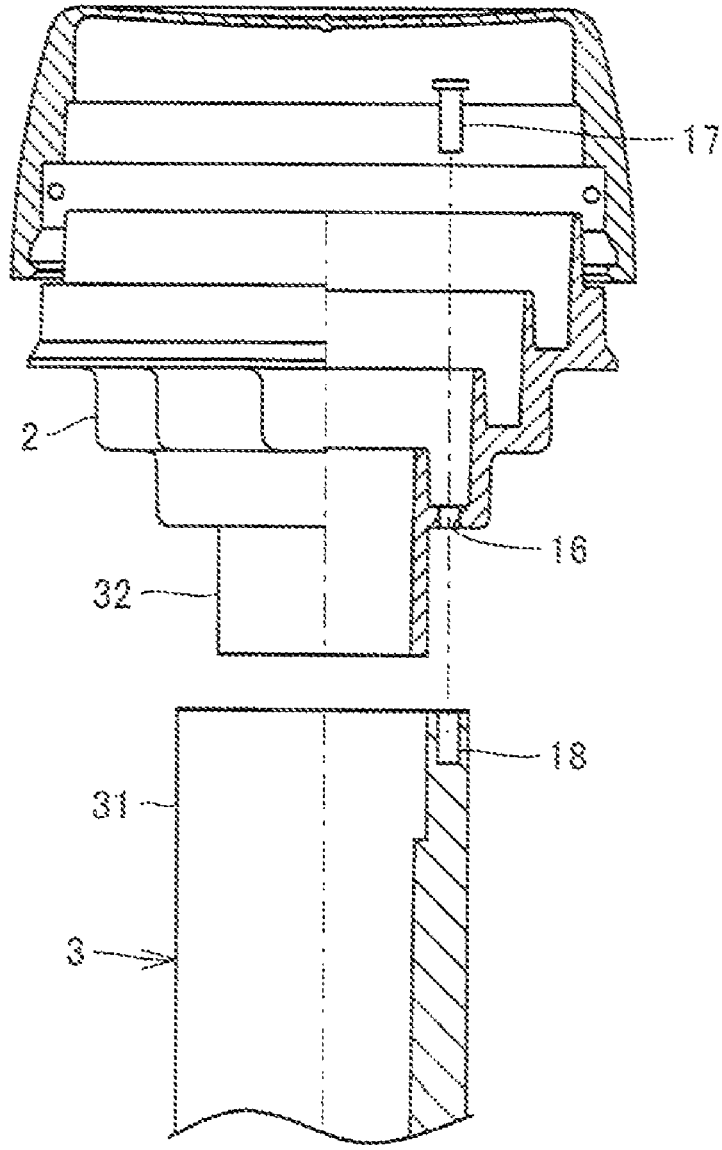
FIG. 12 is an exploded view of still another embodiment of the present invention.
Figure 13:
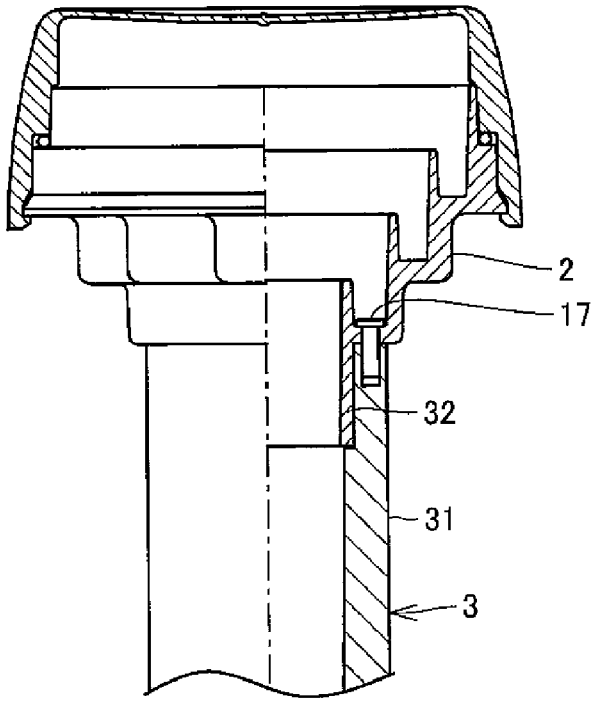
FIG. 13 is a partial cross-sectional front view of the embodiment corresponding to FIG. 12.

FIGS. 12 and 13 show the embodiment where, regarding fixation of the waveguide connected to the main body portion of the LNB and the primary radiator (feedhorn) connected to the tip of the waveguide, a screw fixing hole 16 is provided in the corrugated groove portion of the primary radiator for fixation by a screw 17. In a tip of first waveguide 31, a screw hole 18 is provided. By this structure, male and female threads does not have to be processed, and a collar portion like a flange for fixation is not required. Therefore, a reduction in size, an improvement in productivity and a reduction in costs can be achieved. Furthermore, a groove can be formed closer to the central portion of the waveguide, and this has the effect of improving the performance of the horn.

Figure 14:
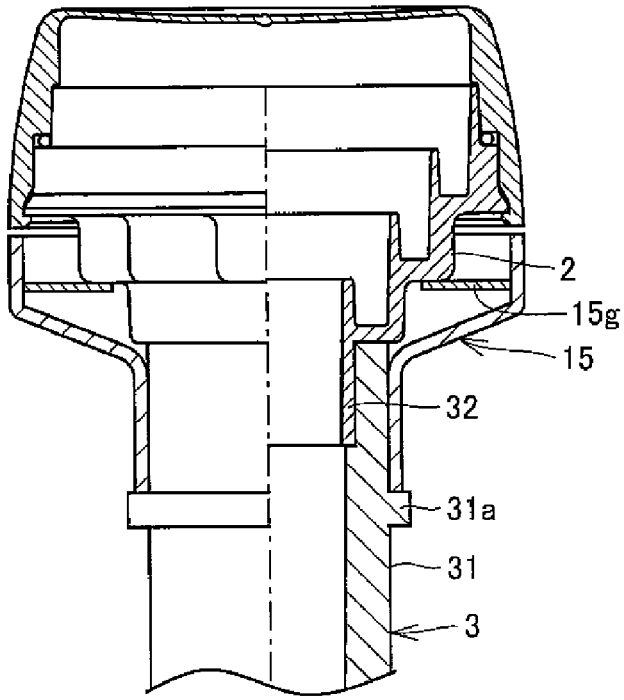
FIG. 14 is a front view of a structure where the cabinet is attached to the embodiment in FIG. 13.
Figure 15:
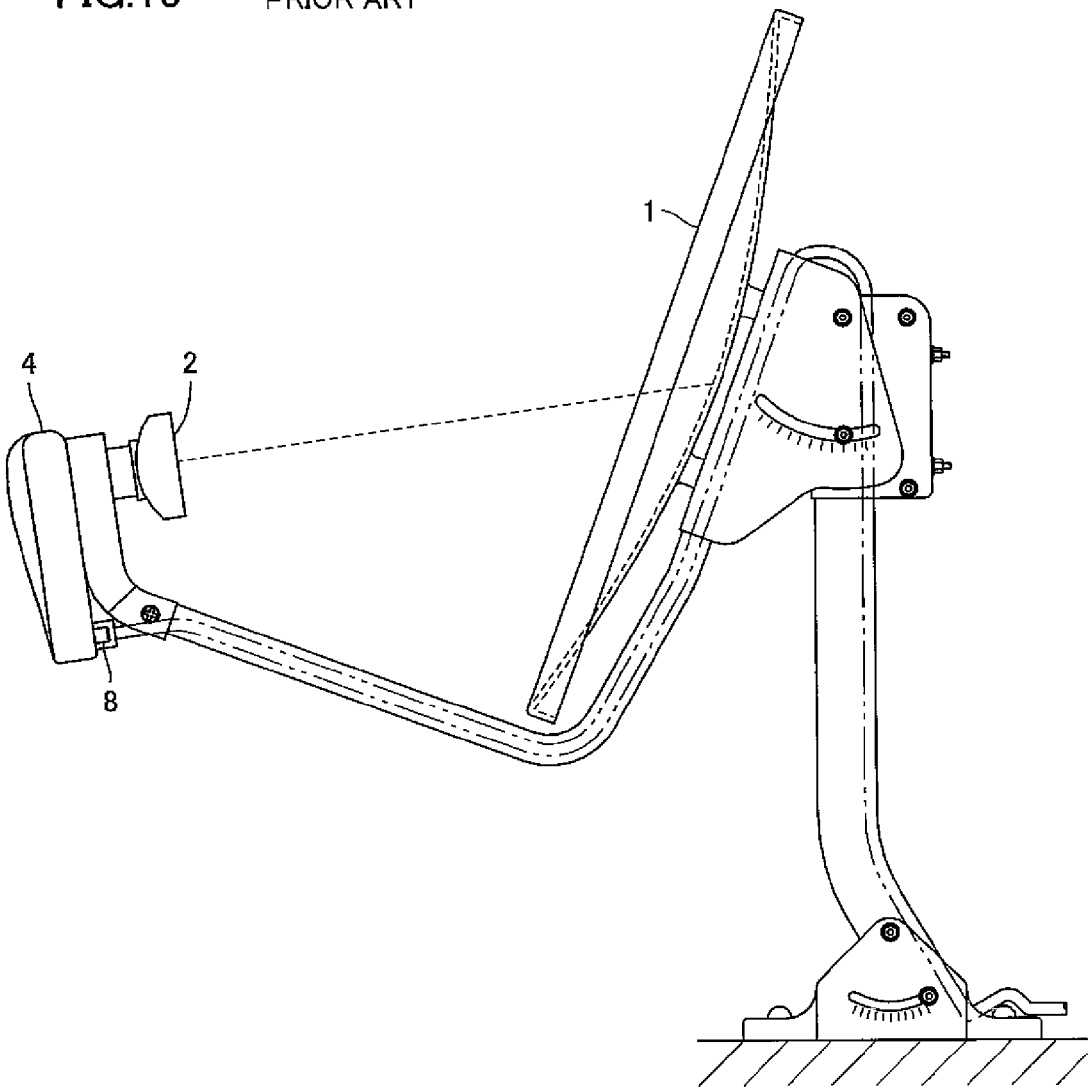
FIG.15 PRIOR ART
FIG. 15 is a side view of an LNB combined with a conventional antenna system.
Figure 16:
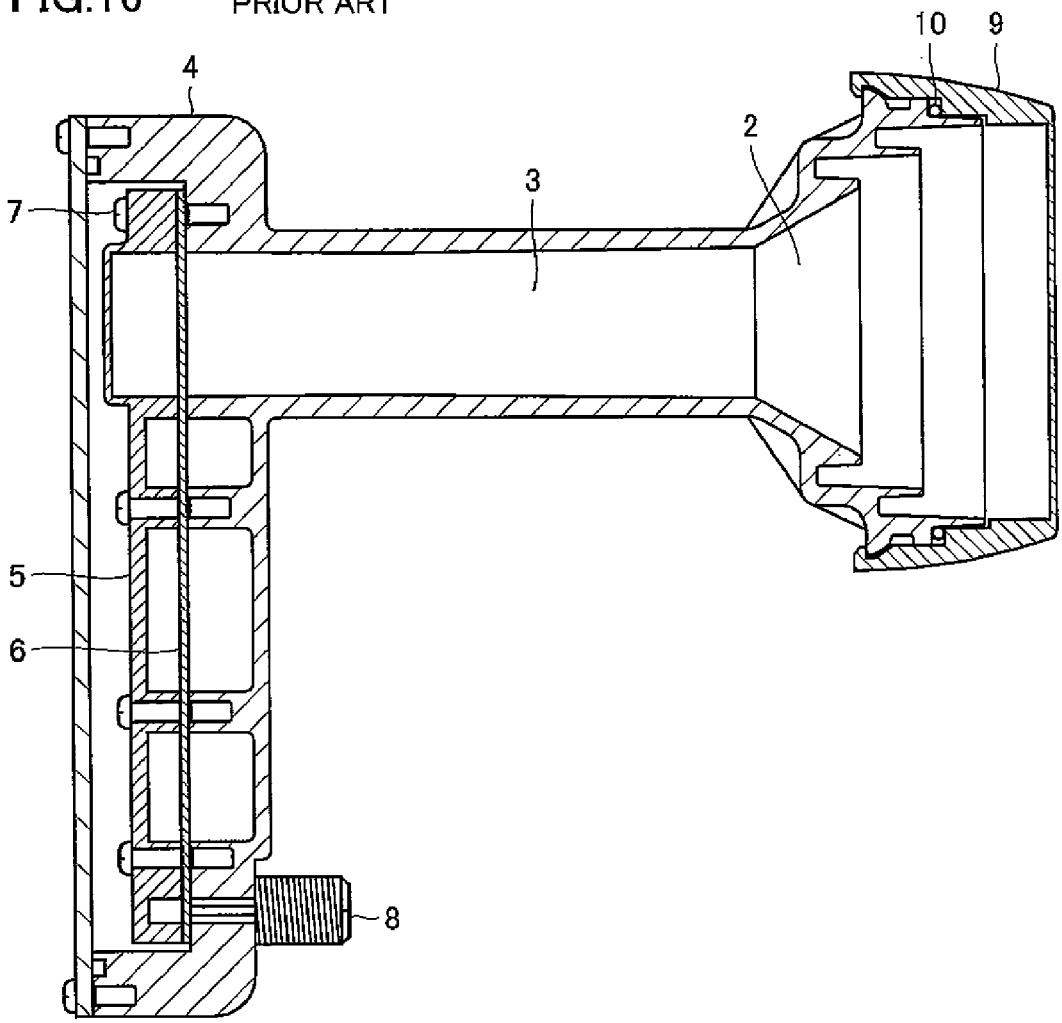
FIG.16 PRIOR ART
FIG. 16 is a cross-sectional view of a configuration of a conventional LNB.
Figure 17:
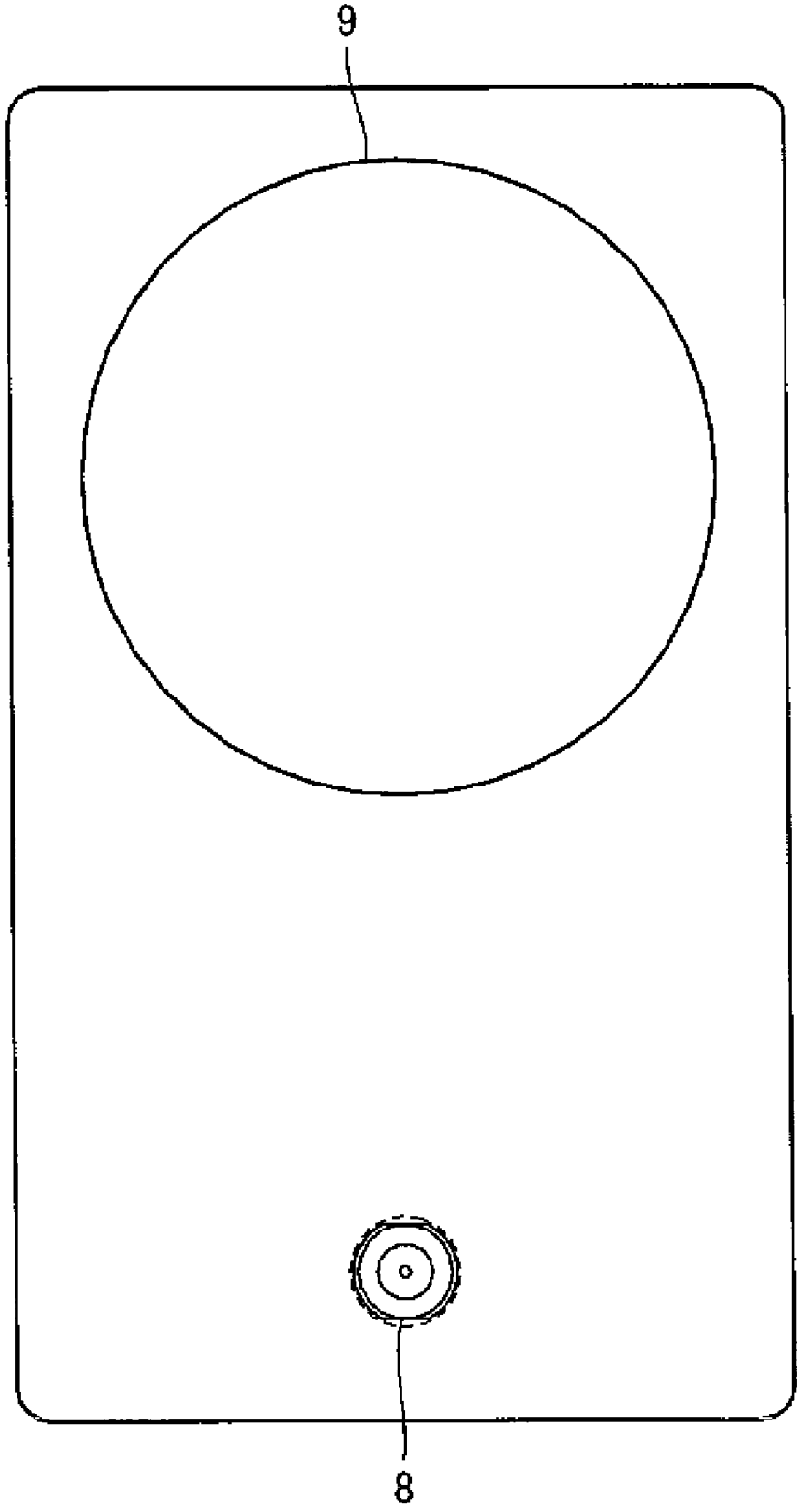
FIG.17 PRIOR ART
FIG. 17 is a right side view of the conventional LNB in FIG. 16.
Figure 18:
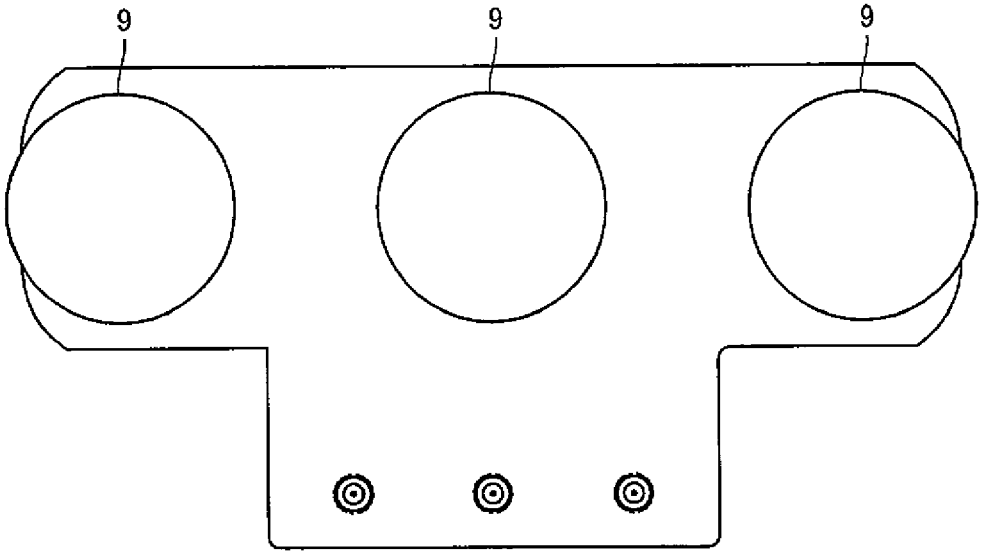
FIG.18 PRIOR ART
FIG. 18 is a diagram of a configuration of an integrated multi-satellite receiving LNB.
Figure 19:
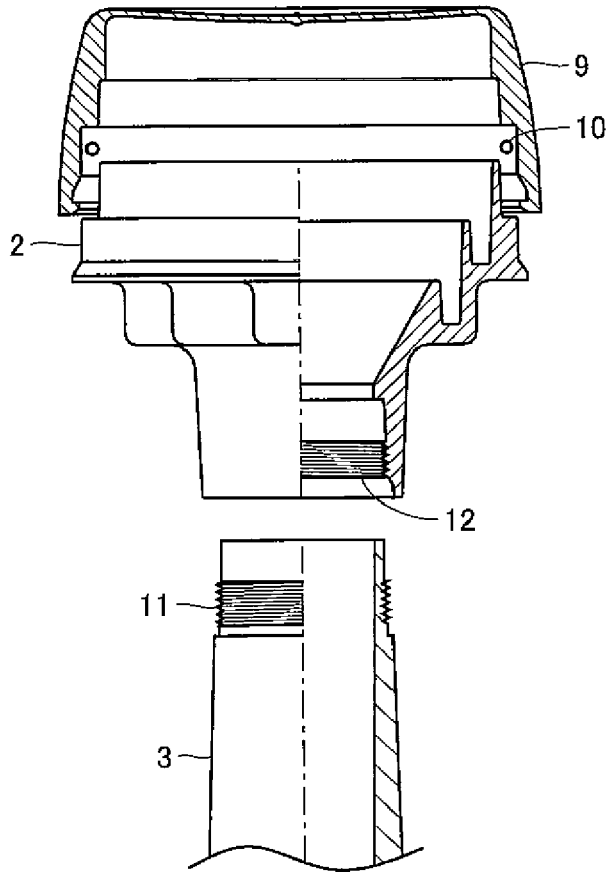
FIG.19 PRIOR ART
FIG. 19 is a partially exploded cross-sectional view of a detailed configuration of a conventional example.
Figure 20:
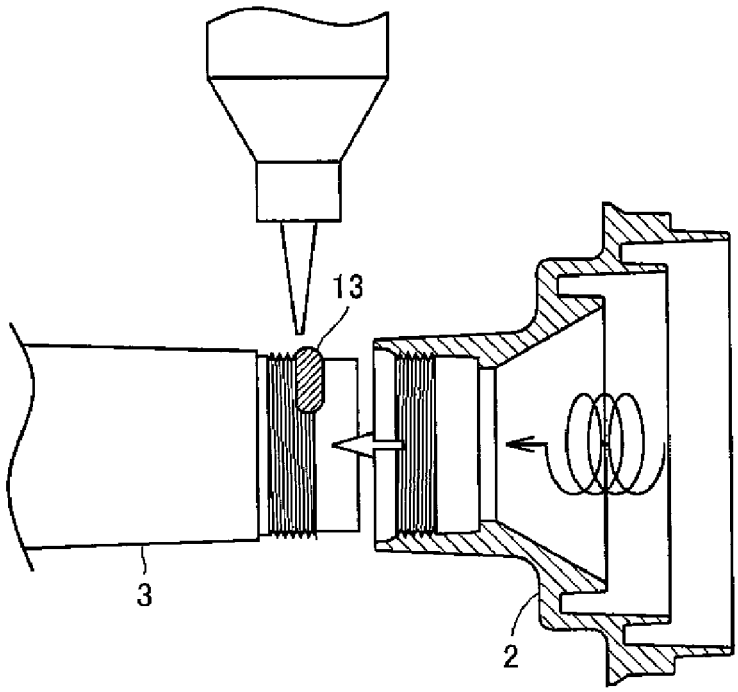
FIG.20 PRIOR ART
FIG. 20 is a diagram for illustrating a connection state in the conventional example in FIG. 19.
Figure 21:
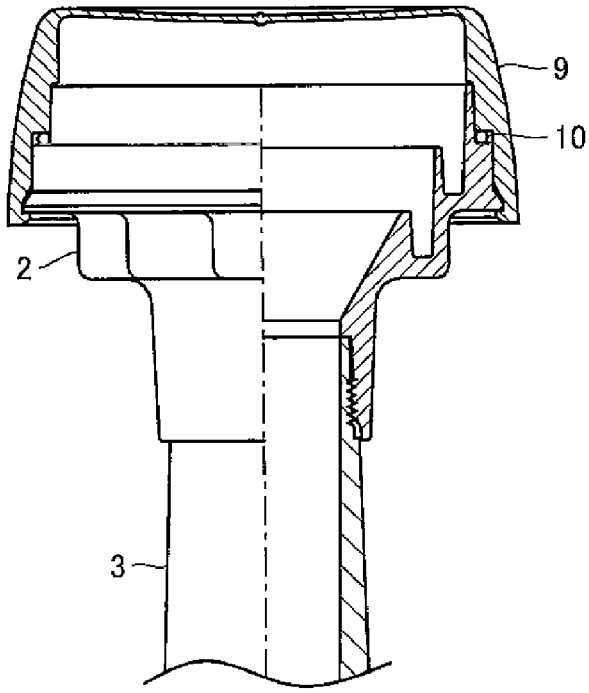
FIG.21 PRIOR ART
FIG. 21 is an assembly diagram of the conventional example in FIG. 19.

In this case, cabinet 15 may also be positioned by a following method that is shown in FIG. 14 in addition to the above-described methods. A circumferential ridge 31*a* abutting on an end of second cylindrical portion 15*c* of the cabinet is provided on the outer circumference of waveguide 31. The above-described cabinet 15 is not divided into two portions, but may be integrated.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A radio wave receiving converter for receiving a satellite broadcast, comprising:

a main body portion including a first waveguide having a male thread portion on an outer circumference of said first waveguide;

a feedhorn including a second waveguide having a female thread portion on an inner circumference of said second waveguide that is screwed on said male thread portion;

a ring-shaped member arranged so as to cover a portion having a circumferential gap between the outer circumference of said first waveguide and the inner circumference of said second waveguide in a connecting portion between said first waveguide and said second waveguide, and including a circumferential wall portion and an annular step portion such that a groove portion where a portion near a tip of said second waveguide is inserted between said ring-shaped member and the outer circumference of said first waveguide is formed; and a sealing agent injected into said groove portion.

2. The radio wave receiving converter according to claim 1, wherein a convex or concave-shaped hole or rib is provided in a corrugated groove portion of said feedhorn.

3. The radio wave receiving converter according to claim 1, wherein a connecting portion between said first waveguide and said second waveguide is covered with a cabinet.

4. The radio wave receiving converter according to claim 3, wherein said cabinet includes a first cylindrical portion having an outside diameter substantially equal to an outside diameter of said feedhorn, a second cylindrical portion covering a smaller-diameter portion of said feedhorn and said connection portion, and a first tapered cylindrical portion connecting said first and second cylindrical portions.

5. The radio wave receiving converter according to claim 4, wherein said cabinet is divided into two portions along a plane including a central axis, and respective ends of a pair of the two portions that face each other are joined together by male and female engaging members.

6. The radio wave receiving converter according to claim 4, wherein a circumferential ridge projecting in such a manner that said second cylindrical portion has a diameter smaller than an outside diameter of said ring-shaped member is provided on an inner surface of said second cylindrical portion of said cabinet.

7. The radio wave receiving converter according to claim 4, wherein a circumferential ridge abutting on an end of said second cylindrical portion of said cabinet is provided on the outer circumference of said first waveguide.

8. The radio wave receiving converter according to claim 3, wherein an abutting strip is provided on an inner circumference of said cabinet such that, when said first waveguide and said second waveguide are connected, an outer circumferential portion of said feedhorn abuts on said abutting strip and a pressing force is generated on said first waveguide side.

9. The radio wave receiving converter according to claim 1, wherein said ring-shaped member is formed of a metal or a conductive resin.

10. The radio wave receiving converter according to claim 1, wherein said sealing agent includes a conductive sealing agent.

11. A satellite broadcast receiving antenna device, comprising the radio wave receiving converter according to claim 1.

12. A radio wave receiving converter for receiving a satellite broadcast, comprising:

a main body portion including a first waveguide, and a feedhorn including a second waveguide connected to said first waveguide, a screw fixing hole being provided in a bottom of a circumferential groove portion of said feedhorn, a screw hole being provided in a tip of said first waveguide, and a screw being screwed and fixed in the screw hole of said first waveguide through said screw fixing hole of said feedhorn, wherein a connecting portion between said first waveguide and said second waveguide is covered with a cabinet.

13. The radio wave receiving converter according to claim 12, wherein said cabinet includes a first cylindrical portion having an outside diameter substantially equal to an outside diameter of said feedhorn, a second cylindrical portion covering a smaller-diameter portion of said feedhorn and said connecting portion, and a first tapered cylindrical portion connecting said first and second cylindrical portions.

14. The radio receiving converter according to claim 13, wherein said cabinet is divided into two portions along a plane including a central axis, and respective ends of a pair of the two portions that face each other are joined together by male and female engaging members.

15. The radio wave receiving converter according to claim 13, wherein a circumferential ridge abutting on an end of said second cylindrical portion of said cabinet is provided on the outer circumference of said first waveguide.

16. The radio wave receiving converter according to claim 12, wherein an abutting strip is provided on an inner circumference of said cabinet such that, when said first waveguide and said second waveguide are connected, an outer circumferential portion of said feedhorn abuts on said abutting strip and a pressing force is generated on said first waveguide side.

17. A satellite broadcast receiving antenna device, comprising the radio wave receiving converter according to claim 12.

* * * * *